United States Patent [19]

Schieber et al.

[11] Patent Number: 4,679,412

[45] Date of Patent: Jul. 14, 1987

[54] METHOD FOR DETERMINING AND CORRECTING THE LENGTH OF A PIECE OF KNITTING PRODUCED ON A FLAT KNITTING MACHINE

[75] Inventors: Hans Schieber; Otto Geitner, both of Bopfingen, Fed. Rep. of Germany

[73] Assignee: Universal Maschinenfabrik Dr. Rudolf Schieber GmbH & Co. KG, Fed. Rep. of Germany

[21] Appl. No.: 848,897

[22] Filed: Apr. 4, 1986

Related U.S. Application Data

[63] Continuation of Ser. No. 568,469, Jan. 5, 1984, abandoned.

[30] Foreign Application Priority Data

Jan. 5, 1983 [DE] Fed. Rep. of Germany ..... 3300240

[51] Int. Cl.[4] ..... D04B 7/00; D04B 15/88

[52] U.S. Cl. ..... 66/71; 66/144 R

[58] Field of Search ..... 66/147, 149, 55, 212, 66/167, 71

[56] References Cited

U.S. PATENT DOCUMENTS

| | | | |
|---|---|---|---|
| 3,370,442 | 2/1968 | Tonkin | 66/55 |
| 3,546,899 | 12/1970 | Meyerhuber | 66/149 |
| 3,668,904 | 6/1972 | Murenbeeld | 66/212 |
| 3,968,663 | 7/1976 | Masters | 66/212 |
| 4,426,856 | 1/1984 | Winter | 66/212 |

FOREIGN PATENT DOCUMENTS

| | | |
|---|---|---|
| 1260072 | 2/1968 | Fed. Rep. of Germany . |
| 1635934 | 4/1972 | Fed. Rep. of Germany . |

*Primary Examiner*—Ronald Feldbaum

*Attorney, Agent, or Firm*—Sughrue, Mion, Zinn, Macpeak & Seas

[57] ABSTRACT

In a method of determining and correcting the length of a piece of knitting being produced on an electronically controlled flat knitting machine, the particular length of the piece of knitting which is being produced is continuously monitored by means of a sensor which supplies a value for the determined actual length to a control circuit where the value is compared with an instantaneous, programmed desired length value, and the determined real length value and the result of the comparison are used to control the stitch length in the following courses and/or the shape and/or type of knitting and pattern of the rest of the piece of knitting. by this means it is possible to produce constant-length pieces of knitting of the same shape, independently of changes in the technical knitting parameters, and controlled by the determination of the relevant actual knitted length of the piece of knitting.

4 Claims, 4 Drawing Figures

METHOD FOR DETERMINING AND CORRECTING THE LENGTH OF A PIECE OF KNITTING PRODUCED ON A FLAT KNITTING MACHINE

This application is a continuation of Ser. No. 568,469 filed on Jan. 5, 1984 now abandoned.

FIELD OF THE INVENTION

This invention relates to a method of determining and correcting the length of a piece of knitting being produced on an electronically controlled flat knitting machine.

DESCRIPTION OF THE PRIOR ART

In the production of pieces of knitting on a flat knitting machine, particularly an electronically controlled flat knitting machine, it is usual to determine and thereby appropriately control both the length of the piece of knitting and also the patterning and the run of the edges of the pieced of knitting from the number of courses to be knitted. However, since differences in the length of the stitches in the courses can arise as a result of differing technical knitting conditions and parameters, one can have different length pieces of knitting for a number of the same knitted articles in spite of having knitted the same number of courses for each.

The various technical knitting conditions and parameters are, in particular, the yarn tension, the withdrawal of the pieces from the machine and the knitting speed. Thus, the yarn, which is drawn from the bobbin, has a variable tension, since the bobbins which are set up on the machine are wound with differing tightness and firmness; consequently, when the yarn is withdrawn from the bobbin it has differing yarn tensions which thus result in different length stitches. This is a particular problem when one changes over to a new bobbin. Differing stitch lengths for their part, as mentioned above, result in different length pieces of knitting. Even different colours can lead to different lengths of stitch.

If in the withdrawal of the pieces of knitting from the machine this is carried out with a greater or lesser withdrawal force, or if the counterpressure roller or the surface of the withdrawal roller has a varying degree of wear, then this also results in varying withdrawal tensions and consequently in different length pieces of knitting. The knitting speed is also a determining factor, and this can vary for example as a result of fluctuations in the electricity supply voltage. As a result of this one can find that pieces of knitting knitted at different times of the day, and accordingly under conditions of differing mains supply load, have different lengths, since the knitting speed has an effect on the stitch length.

In the manufacture of ready-to-wear articles of clothing it is necessary to produce knitted articles which are always of the same length and which match one another irrespective of the technical knitting conditions, particularly if true-to-shape knitted articles are to be fitted together. In addition, it is desirable if exactly the required number of knitted articles of predetermined ready-to-wear sizes can be produced, thus avoiding the need to sort the knitted articles into individual ready-to-wear sizes, as would otherwise be necessary.

From U.S. Pat. No. 3,546,899 a method of producing constant-length articles on knitting machines is known in which the length of the knitted product is continuously monitored, this actual length value is compared with a desired length value, and only the result of this comparison is used to control the stitch length and consequently just the length of the knitted article.

SUMMARY OF THE INVENTION

It is an object of the present invention to provide a method of the type first referred to above by means of which the length and shape of a piece of knitting coming off a flat knitting machine can be accurately adjusted during the knitting process and thereby compensation made for the changes in length and shape which arise from the various technical knitting parameters.

In accordance with the present invention there is provided a method of the type first referred to above in which the particular length of the piece of knitting being produced on the machine is continuously monitored by means of a sensor positioned between needle bed and knitwear withdrawal means, the determined actual length value is fed to a control circuit and is there compared with an instantaneous programmed desired length value, and the result of the comparison and the determined actual length value are used to control the stitch length and/or number of susequent courses and the shape and the type of knitting and the pattern of the rest of the piece of knitting.

With this method in accordance with the invention the establishment of the length and shape of a piece of knitting is no longer exclusively dependent on establishing a predetermined and invariable number of courses, but the number of courses, and the stitch lengths and possibly the numbers of stitches in the individual courses is varied in dependence on the actual determined knitted length of the piece of knitting, if this proves to be necessary as a consequence of changes in the technical knitting conditions and parameters. As a result, pieces of knitting of constant length and of the same shape can be produced satisfactorily independently of the technical knitting parameters.

The length of the piece of knitting can be determined by the sensor from the piece of knitting itself which is being produced or from a narrow measuring strip knitted next to the piece of knitting which is being produced. This second possibility is particularly advantageous if the piece of knitting has an irregular contour or is of non-uniform content, for example includes a hole pattern, in the region of sensing by the sensor.

Preferably, the result of the comparison with the desired length value is used to adjust the height of the needle retractor elements in the knitting cam unit in advance of the knitting of the next course and to change the number of the succeeding courses. In this way a different stitch length is set up for the next following course and, additionally, for balance, more or fewer courses are knitted in the further production of the knitted piece.

Preferably, for the knitting of correctly shaped knitted pieces, the determined actual length value is used to control the number of stitches in the following course. Consequently, the width of the piece of knitting is permanently monitored during the knitting process and is controlled in dependence on the actual real length value of the piece of knitting.

The method of the present invention offers the advantage that the control of the knitting process can be effected directly on the basis of a contour for a piece of knitting programmed into the machine control system, for example in the form of a section curve, in dependence on the actual length of the piece of knitting which is being produced.

The apparatus for carrying out the method of the present invention comprises a digital control circuit connected to the machine control system and connected to a sensor arranged to monitor the piece of knitting or a measuring strip and positioned between needle bed and knitwear withdrawal means, with the digital control circuit comprising a microprocessor. Consequently, all the necessary calculations can be carried out in the control circuit from the measured actual length value of the piece of knitting.

The sensor preferably comprises a friction wheel or pin-wheel which is moved by the piece of knitting or measuring strip and which is moved by direct contact with the piece of knitting or measuring strip so that the sensor can relay the particular actual length value to the control circuit.

Alternatively, the sensor can be an optical or inductive sensor which carries out its sensing operation without contact with the piece of knitting or the measuring strip.

BRIEF DESCRIPTION OF THE DRAWINGS

The invention will now be described in more detail with reference to the embodiments shown in the accompanying drawing. In the drawing.

DESCRIPTION OF THE PREFERRED EMBODIMENTS

Figure 1:
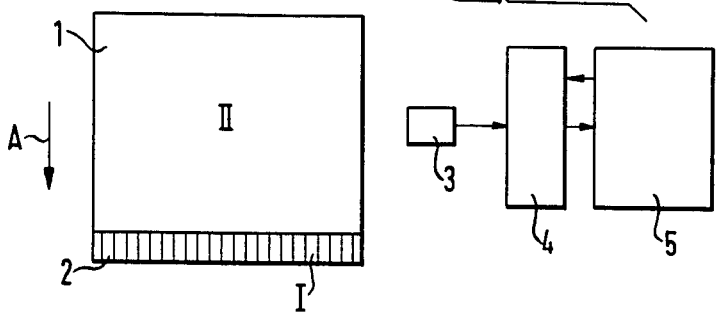
FIG. 1 is a schematic illustration of an arrangement for determining and correcting the length of a piece of knitting being produced on a flat knitting machine, in which a sensor senses the piece of knitting indirectly.
Figure 2:
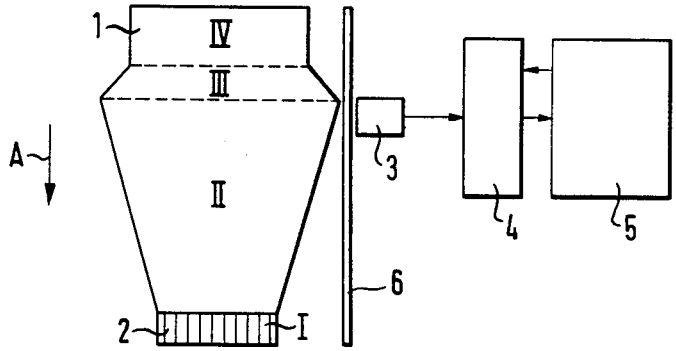
FIG. 2 is a schematic illustration of an arrangement similar to FIG. 1, but in which here a narrow measuring strip is knitted adjacent to the piece of knitting and is sensed by the sensor.
Figure 3:
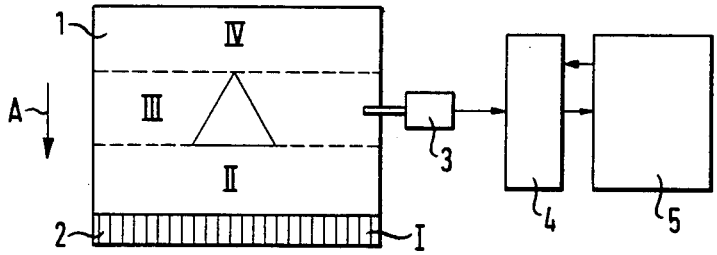
FIG. 3 is a schematic illustration of an arrangement similar to FIGS. 1 and 2, but in which here the sensor is in direct contact with the piece of knitting.
Figure 4:
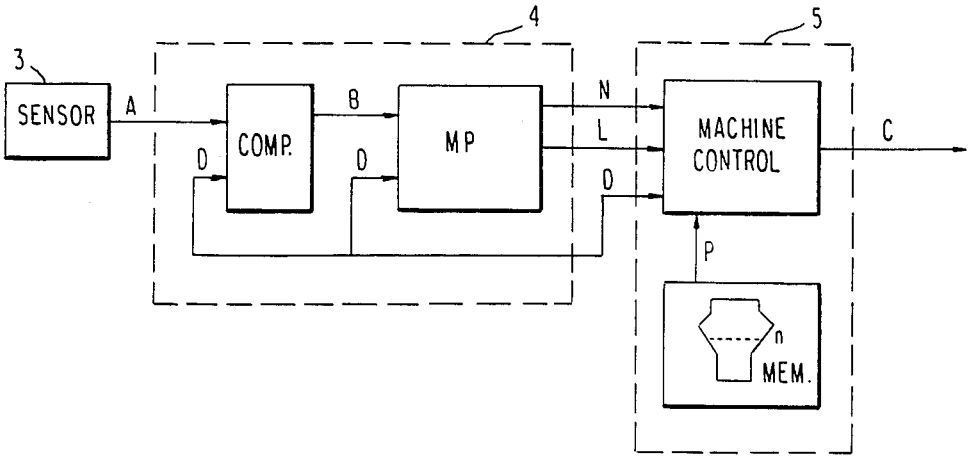
FIG. 4 is a schematic circuit diagram of the circuit for controlling the machine according to the present invention.

In each of FIGS. 1 to 3 of the drawing there is shown a piece of knitting 1 with a welt 2. The piece of knitting is drawn off the knitting machine in the direction of arrow A by a withdrawal device (not shown). Between the needle bed and the withdrawal device there is mounted a sensor 3 on the frame of the flat knitting machine which determines the particular actual length of the piece of knitting which is being produced and relays the information about this length to a digital control circuit 4. The digital control circuit 4 for its part is connected to a machine control system 5 and influences the machine control system 5 in such a way that length, shape and possibly pattern of the piece of knitting are controlled exclusively in dependence on the measured actual length of the piece of knitting. By means of the machine control system 5 one can also vary the density setting for the stitches, which means that the modified density setting generated by the measurement of the relevant actual knitted length of the piece of knitting by the sensor and the digital control circuit has a direct effect on the further control of the shape and length of the piece of knitting.

The sensor 3 may be an optical or inductive sensor which senses the piece of knitting, or alternatively, as shown in FIG. 3, it may comprise a friction wheel or pin-wheel which is moved by the piece of knitting or measuring strip.

In FIG. 1 there is shown a piece of knitting with edges which run parallel to each other. In this case the digital control circuit 4 generates command for the machine control system 5 to knit the main body to the length II as soon as the sensor detects that the length I of the welt 2 has been knitted.

In the embodiment shown in FIG. 2, a narrow measuring strip is knitted simultaneously adjacent to the piece of knitting and this strip is detected by the sensor 3 as representative of the actual knitted length. As soon as the sensor 3 has detected the length I of the piece of knitting, the machine control system 5 receives a command to begin the continuation of the piece of knitting, i.e. to increase the number of stitches for the subsequent courses. The increase in the number of stitches is effected under the direct influence of the measurement of the actual length of the piece of knitting over the length II. When the actual length II is detected as having been knitted, then in an analogous way the decrease in width of the piece of knitting over the length III is controlled. Finally, over the length IV the number of stitches in the courses remains unchanged.

The piece of knitting shown in FIG. 3 has two parallel edges, but includes a pattern within the middle portion III of its length. Here, with the described arrangement, the position and shape of the pattern can be controlled in dependence on the actual knitted length III and beginning after detection of completion of the actual knitted lengths I and II.

According to the invention a digital control circuit 4 receives an actual length signal A from a sensor 3 and a desired length signal D from the machine control system 5. These two signals A and D are compared in a comparator, the resulting comparison signal B as well as the desired length signal D being fed to a microprocesser in the digital control circuit 4. In the case where the resulting comparison signal B is not serial, the microprocessor of the digital control circuit 4 will issue an overruling course number signal N and/or overruling stitch length signal L to the machine control system 5.

Assuming the actual length signal A is greater than the desired length signal D and therefore the resulting comparison signal B will have a positive value during knitting course n, there will be produced an overruling course number signal N for the next course to be knitted advising that the next course to be knitted is course $n+2$ instead of being the course $n+1$ as would ordinarily be the case. The machine control signal C will then for the next course to be knitted include the number and location of stitches in course $n+2$ (shape) instead of course $n+1$, and also the kind and color of stitches in course $n+2$ (pattern) instead of $n+1$. Therefore the shape and pattern of the remainder of the knitted piece are controlled independently of the comparison.

In the case assumed above the microprocessor of the digital control circuit 4 can also issue an overruling stitch length signal L providing a smaller or bigger stitch length for the remaining courses of the knitting piece if deleting one course from the knitting of the remaining knitted piece will not be sufficient to reach the desired length of the knitted piece with the end of the knitting process.

To summarise therefore, the total length and overall shape of the pieces of knitting of constant length and constant size produced in accordance with the invention are no longer determined and controlled by counting predetermined numbers of courses which are invariable during the knitting process, but any one or more of the length, shape and pattern of the pieces of knitting is modified during the course of the knitting in accordance with changing technical knitting conditions and parameters and with due regard to the actual length and width of the knitting being produced.

We claim:

1. A method of determining and correcting the length of a piece of knitting being produced on an electronically controlled flat knitting machine, comprising the steps of:

(a) continuously determining the real length of the piece of knitting being produced by means of a sensor between a needle bed and a knitted piece withdrawal means;

(b) comparing in a comperator of a digital control circuit the determined real length value with an instantaneous desired length value stored in a programmed memory of a machine control system;

(c) processing resulting comparison value and said desired length value in a microprocessor of said digital control circuit;

(d) feeding an overruling stitch length signal and an overruling course number signal from said microprocessor to a machine control circuit in said machine control system;

whereby the stitch length and the number of subsequent courses as well as the shape and the type of knitting and pattern of the remainder of the piece being knitted are controlled by said resulting comparison value and said desired length value.

2. A method as claimed in claim 1 wherein in step (d) said overruling stitch length signal is used to adjust a height of needle retractor elements in a knitting cam unit in advance of knitting a next course, and said overruling course number signal is used to change the number of succeeding courses and to set the number of stitches in the following courses.

3. A method as claimed in claim 1 wherein the real length is determined by monitoring the knitted piece being produced itself during production thereof.

4. A method as claimed in claim 1 wherein the real length is determined by monitoring a narrow measuring strip being knitted adjacent to the piece of knitting being produced.

* * * * *